US007970328B2

(12) United States Patent
Halfyard et al.

(10) Patent No.: US 7,970,328 B2
(45) **Date of Patent: *Jun. 28, 2011**

(54) SYSTEM AND METHOD FOR PREPARING MAGNETIC INK CHARACTER RECOGNITION READABLE DOCUMENTS

(75) Inventors: Kurt I. Halfyard, Mississauga (CA); Christine D. Anderson, Hamilton (CA); Gordon Sisler, St Catharines (CA); T. Brian McAneney, Burlington (CA)

(73) Assignee: Xerox Corporation, Norwalk, CT (US)

( * ) Notice: Subject to any disclaimer, the term of this patent is extended or adjusted under 35 U.S.C. 154(b) by 758 days.

This patent is subject to a terminal disclaimer.

(21) Appl. No.: 11/985,737

(22) Filed: Nov. 16, 2007

(65) Prior Publication Data

US 2009/0129832 A1 May 21, 2009

(51) Int. Cl.
*G03G 15/20* (2006.01)

(52) U.S. Cl. ..... 399/325

(58) Field of Classification Search ..... None
See application file for complete search history.

(56) References Cited

U.S. PATENT DOCUMENTS

| | | | | |
|---|---|---|---|---|
| 4,231,593 | A | 11/1980 | Bell, Jr. et al. | 283/6 |
| 4,343,243 | A | 8/1982 | Gentry et al. | 101/96 |
| 4,558,108 | A | 12/1985 | Alexandru et al. | 526/340 |
| 4,634,148 | A | 1/1987 | Greene | 283/70 |
| 4,688,050 | A | 8/1987 | Tsao | 346/76 |
| 4,891,240 | A | 1/1990 | Ward et al. | 427/11 |
| 5,084,359 | A | 1/1992 | Talvalkar et al. | 428/484 |
| 5,089,350 | A | 2/1992 | Talvalkar et al. | 428/484 |
| 5,135,569 | A | 8/1992 | Mathias | 106/22 |
| 5,456,498 | A | 10/1995 | Greene | 283/70 |
| 5,514,467 | A | 5/1996 | Berkes et al. | 428/329 |
| 5,525,572 | A | 6/1996 | Williams | 503/201 |
| 5,554,480 | A | 9/1996 | Patel et al. | 430/137 |
| 5,556,727 | A | 9/1996 | Ciccarelli et al. | 430/45 |
| 5,639,708 | A | 6/1997 | Golemo et al. | 503/205 |
| 5,759,734 | A | 6/1998 | Malhotra | 430/124 |
| 5,843,579 | A | 12/1998 | Roth et al. | 428/484 |
| 5,866,637 | A | 2/1999 | Lorenz | 523/161 |
| 5,888,622 | A | 3/1999 | Pinell et al. | 428/195 |
| 6,032,004 | A | 2/2000 | Mirabella, Jr. et al. | 399/90 |
| 6,048,118 | A * | 4/2000 | Martinez et al. | 400/208 |
| 6,096,443 | A * | 8/2000 | Malhotra et al. | 428/690 |
| 6,155,604 | A | 12/2000 | Greene et al. | 283/70 |
| 6,291,121 | B1 | 9/2001 | Hollenbaugh, Jr. et al. | 430/108.7 |
| 6,326,119 | B1 | 12/2001 | Hollenbaugh, Jr. et al. | 430/137.2 |
| 6,365,316 | B1 | 4/2002 | Stamp et al. | 430/111.41 |
| 6,530,601 | B2 | 3/2003 | Greene | 283/57 |
| 6,613,403 | B2 | 9/2003 | Tan et al. | 428/29 |
| 6,673,500 | B1 | 1/2004 | Patel et al. | 430/108.2 |
| 6,701,304 | B2 | 3/2004 | Leon | 705/401 |
| 6,743,561 | B2 | 6/2004 | Heeks et al. | 430/124 |
| 6,782,144 | B2 | 8/2004 | Bellavita et al. | 382/310 |
| 6,824,942 | B2 | 11/2004 | Silence et al. | 430/108.4 |
| 6,850,725 | B2 | 2/2005 | Silence et al. | 399/297 |

(Continued)

*Primary Examiner* — Stephen D Meier
*Assistant Examiner* — Alexander C Witkowski
(74) *Attorney, Agent, or Firm* — Alix, Yale & Ristas, LLP

(57) ABSTRACT

Disclosed herein is printing system comprising a first printer configured to print a first set of data on a document, the first printer including a fuser employing fuser oil, and an in-line spray coater configured to deposit a wax coating on a portion of the document to repel or cover fuser oil. A corresponding method is also described. The method and system are useful for preparing MICR encoded documents such as checks.

22 Claims, 5 Drawing Sheets

U.S. PATENT DOCUMENTS

| | | | | |
|---|---|---|---|---|
| 6,970,246 | B2 | 11/2005 | Hansen | 356/417 |
| 7,058,350 | B2 | 6/2006 | Hsieh et al. | 399/380 |
| 7,522,869 | B2 * | 4/2009 | Anderson et al. | 399/297 |
| 2004/0137203 | A1 | 7/2004 | Adams et al. | 428/195.1 |
| 2005/0048294 | A1 * | 3/2005 | Kaplan et al. | 428/447 |
| 2005/0285918 | A1 | 12/2005 | McElligott et al. | 347/101 |
| 2006/0118738 | A1 | 6/2006 | Ross et al. | 250/556 |
| 2006/0118739 | A1 | 6/2006 | Ross et al. | 250/556 |
| 2006/0186348 | A1 | 8/2006 | Nguyen et al. | 250/484.4 |
| 2007/0095921 | A1 | 5/2007 | Roth | 235/491 |
| 2007/0108392 | A1 | 5/2007 | Ross | 250/458.1 |

* cited by examiner

SYSTEM AND METHOD FOR PREPARING MAGNETIC INK CHARACTER RECOGNITION READABLE DOCUMENTS

BACKGROUND

The embodiments described herein generally relate to processing pre-printed documents and more particularly to a system and method for coating pre-printed documents.

As explained in commonly assigned U.S. Patent Publication 2005/0285918 (the complete disclosure of which is incorporated herein by reference) inks suited for use in printing magnetic ink character recognition (MICR) readable documents are known. Such inks are generally employed in the printing and preparation of documents intended for automated processing, such as checks.

Of particular interest in this instance are those inks which contain a magnetic pigment or component in an amount sufficient to generate a magnetic signal that is strong enough to be MICR-readable. Such inks generally fall into the category of magnetic inks in general, and in the more specific subcategory of MICR-readable inks. Generally, the ink is used to print a portion of a document, such as a check, bond, security card, etc. containing an identification code area, which is intended for automated processing. The characters of this identification code are usually MICR encoded. The document may be printed with a combination of MICR-readable ink and non-MICR-readable ink, or with just MICR-readable ink. The document thus printed is then exposed to an appropriate source or field of magnetization, at which time the magnetic particles become aligned as they accept and retain a magnetic signal. The identification code on the document can then be recognized by passing it through a reader device that detects or reads the magnetic signal of the MICR imprinted characters in order to recognize the coding printed on the document.

Of particular importance in the foregoing is the ability of the printed characters to adhere to the sheet and thus retain their readable characteristic such that they are easily detected by the detection device or reader. The magnetic charge, known as "remanence," also must be retained by the pigment or magnetic component.

In some situations, magnetic thermal transfer ribbon printing mechanisms are used to generate MICR-readable characters or indicia. In this printing technique, the magnetic component is retained on a ribbon substrate by a binder and/or wax material. Then, upon application of heat and pressure, the magnetic component is transferred to a substrate. Other details regarding thermal ribbon printing technology are discussed in detail in U.S. Patent Publication 2004/0137203, the entire contents of which are also incorporated herein by reference.

U.S. Pat. No. 5,888,622 discloses a coated cellulosic web product and a coating composition that provides enhanced toner adhesion for documents printed using noncontact printing devices such as ion deposition printers. U.S. Pat. No. 4,231,593 discloses a bank check with at least two coatings, one of which is electrically conductive, and the other which is electrically non-conductive. In some cases, a MICR ink is applied as an additional coating.

It would be useful to develop a method of conditioning documents to receive and retain MICR encoded inks.

SUMMARY

One embodiment is a printing system comprising a first printer configured to print a first set of data on a document, the first printer including a fuser employing fuser oil, and an in-line spray coater configured to deposit a wax coating on a portion of the document to mitigate fuser oil.

Another embodiment is a printing system comprising a spray coater, an electronic reader, a data processor, and a magnetic ink character recognition encoder. The spray coater is configured to deposit a wax coating on a portion of a pre-printed document to mitigate fuser oil. The electronic reader is configured to read an amount on the pre-printed document. The data processor is configured to process the electronically read amount, and the magnetic ink character recognition encoder is configured to encode the read amount on the coated portion of the pre-printed document.

Yet another embodiment is a method comprising performing a printing process to produce a pre-printed document, the printing process resulting in a residual coating of fuser oil on the surface of the pre-printed document, and spraying a portion of the pre-printed document with a wax emulsion to form a coated portion configured to mitigate fuser oil and subsequently receive and retain a magnetic image.

A further embodiment is a method comprising performing a printing process to produce a pre-printed document, the printing process resulting in a residual coating of fuser oil on the surface of the pre-printed document, spraying a portion of the pre-printed document with a wax emulsion to form a coated portion configured for future application and adhesion of a magnetic image, and processing the pre-printed document in at least one of a binding and a lamination process.

Another embodiment is a method comprising spray coating with a wax emulsion a portion of a pre-printed document having fuser oil thereon, reading an amount that was previously printed on the pre-printed document, processing the amount into processed data, and recording the processed data on the spray coated portion using a magnetic ink character recognition encoder having a thermal transfer ribbon.

DETAILED DESCRIPTION

Figure 1:
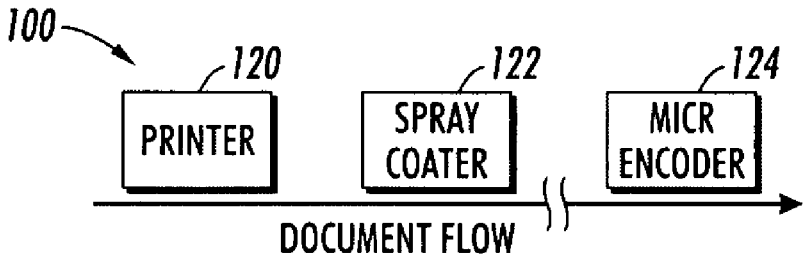
FIG. 1 is a schematic drawing of a system and method used with embodiments herein.

A system and method for spray coating a portion of a document prior to application of a MICR ink are described herein. The process improves the adhesion and/or magnetic signal strength of a MICR ink printed on a portion of a document that has fuser oil thereon. In embodiments, the MICR encoding produces documents with a reader rejection rate that is substantially lower than that resulting from MICR printing on uncoated documents having fuser oil thereon.

As used herein, a "pre-printed document" is a document that has primary MICR encoded or non-MICR encoded images printed thereon. A "wax emulsion" is a dispersion of a wax in a continuous liquid phase. The wax is held in suspension by an emulsifier. "Magnetic signal strength" as used herein refers to the strength of a magnetic signal from a MICR ink deposited on a document. As used herein, a "document" is media having an image printed thereon. The term "receive and retain a magnetic image" as used herein refers to the ability of the wax coating to impart sufficient adhesion to a subsequently applied MICR image that the MICR image has a magnetic signal strength of at least 80%. The phrase "mitigate fuser oil" as used herein refers to a lessening of the negative impact that fuser oil has on adhesion and resulting magnetic signal strength of a MICR image. The term "printer" as used herein encompasses any apparatus, such as a digital copier, bookmaking machine, facsimile machine, multi-function machine, etc. that performs a print outputting function for any purpose.

On negotiable pre-printed documents such as checks and other negotiable instruments, the MICR amount field often is encoded as part of the bank's "proof of deposit" operation. One popular device for encoding MICR amounts uses magnetic thermal transfer ribbon print technology. Thermal ribbon readability in MICR reader/sorters can be degraded by prior application of some fuser oils (release agents) used when originally printing the check or pre-printed document. While mercapto-functional release agents usually have minimal impact on readability rates, those containing amino-functional groups are found to degrade the readability of the encoded data. Embodiments herein present a methodology for eliminating the negative impact of amino-functional group release agents on encoders, including but not limited to magnetic thermal transfer ribbon (MTTR) and impact transfer ribbon MICR encoders, allowing development of MICR products on xerographic platforms, including those that use amino-functional group release agents.

Xerox DocuTech® and other machines can be used to print checks, and in embodiments, MICR encoding checks. The process allows for basic check writing abilities, but does not provide the flexibility to use color or allow for personalization of checks. In some machines, such as the DocuTech® family of machines, the background and initial MICR encoding is all performed on one machine. Fuser oils such mercapto, amino and other functionalized PDMS fuser oils, non-functionalized PDMS oils, and mixtures thereof, are used in such machines. The fuser oils are used to strip the sheets from the fuser members. Further, secondary MICR encoding is performed at the "bank of first deposit" where the MICR imprinting is placed over the fused check. When the completed check is placed through the check reader/sorter, the reject rate usually should be at or below 0.5%.

The spray coating of a wax emulsion on a portion of a document containing fuser oil mitigates the negative impact of the fuser oil. While not intending to be bound by theory, it is believed that the coating forms a film of wax over the release oil. The wax of the coating also is believed to be compatible with the wax used in the encoding ribbon, providing a binding function for the ink on the transfer ribbon and thereby encouraging transfer of the imprinted figures from the ribbon to the document. The spray coating of a wax emulsion on a portion of the document that is subsequently contacted with fuser oil also serves to mitigate the fuser oil, and this effect is believed to be due to microscopic cracks in the wax coating which allow for absorption of the fuser oil into the paper.

The wax coating can be used on both coated and uncoated paper on a wide range of paper stock. Typical fuser oils that can be coated with the wax include non-functionalized and functionalized PDMS fuser oils, such as amino functionalized PDMS, and mixtures containing amino functionalized fuser oils along with other fuser oils. The oil rate per copy ranges from about 1 to about 20 microliters per copy or 0.002-0.035 $\mu L/cm^2$.

The resulting magnetic signal strength of an encoded image applied over the wax coating is at least 80%, and sometimes is at least 95% and in certain cases is over 100%. Magnetic signal strength of a magnetic image can be measured by using known devices, including the MICR-Mate 1, manufactured by Checkmate Electronics, Inc.

In one embodiment, the method is used to provide secondary MICR encoding on a document that has first been processed with a xerographic printer, and in particular, a high-speed xerographic printer, using a first MICR toner for primary MICR encoding, followed by a high-speed xerographic printing machine using non-MICR toner. In embodiments, the MICR toner used for primary encoding is usually black and the non-MICR xerographic toner can be black or color, and in embodiments is color. The xerographic MICR printer and non-MICR xerographic print engine may be separate machines, which are either loosely or tightly coupled. The document, often but not necessarily, is then sent to a different location for the secondary encoding process.

MICR Toner Compositions

The MICR toner compositions selected herein for use in primary MICR encoding may comprise resin particles, magnetites, and optional colorant, such as pigment, dyes, carbon blacks, and waxes such as polyethylene and polypropylene. The toners can further include a second resin, a colorant or colorants, a charge additive, a flow additive, reuse or recycled toner fines, and other ingredients. A carrier optionally can be included. Also there can be blended at least one surface additive with the ground and classified melt mixed toner product. Toner particles in embodiments can have a volume average diameter particle size of about 6 to about 25, or from about 6 to about 14 microns.

Resin

Illustrative examples of resins suitable for MICR toner and MICR developer compositions herein include linear or branched styrene acrylates, styrene methacrylates, styrene butadienes, vinyl resins, including linear or branched homopolymers and copolymers of two or more vinyl monomers; vinyl monomers include styrene, p-chlorostyrene, butadiene, isoprene, and myrcene; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; and the like. A specific example includes styrene butadiene copolymers, mixtures thereof, and the like, and also styrene/n-butyl acrylate copolymers, PLIOLITES®; suspension polymerized styrene butadienes, reference U.S. Pat. No. 4,558,108, the disclosure of which is totally incorporated herein by reference.

Magnetite

Various forms of iron oxide can be used as the magnetite. Magnetites can include a mixture of iron oxides (for example, $FeO.Fe_2O_3$) and carbon black, including those commercially available as MAPICO BLACK®. Mixtures of magnetites can be present in the toner composition in an amount of from about 10 to about 70 percent by weight, or from about 10 percent by weight to about 50 percent by weight. Mixtures of carbon black and magnetite with from about 1 to about 15 weight percent of carbon black, or from about 2 to about 6 weight percent of carbon black, and magnetite, in an amount of, for example, from about 5 to about 60, or from about 10 to about 50 weight percent, can be selected.

Wax

Illustrative examples of aliphatic hydrocarbon waxes include low molecular weight polyethylene and polypropylene waxes with a weight average molecular weight of, for example, about 500 to about 5,000. Also, there are included in the toner compositions low molecular weight waxes, such as polypropylenes and polyethylenes commercially available from Allied Chemical and Petrolite Corporation, EPOLENE N-15® commercially available from Eastman Chemical Products, Inc., VISCOL 550-P®, a low weight average molecular weight polypropylene available from Sanyo Kasei K.K., and similar materials. The commercially available polyethylenes selected have a molecular weight of from about 1,000 to about 1,500, while the commercially available polypropylenes used for the toner compositions are believed to have a molecular weight of from about 4,000 to about 5,000. The wax can be present in the toner in an amount of from about 4 to about 7 weight percent.

Optional Carrier

Illustrative examples of carrier particles include iron powder, steel, nickel, iron, ferrites, including copper zinc ferrites, and the like. The carrier can be coated with a costing such as terpolymers of styrene, methylmethacrylate, and a silane, such as triethoxy silane, including for example KYNAR® and polymethylmethacrylate mixtures (40/60). Coating weights can vary as indicated herein. However, the weights can be from about 0.3 to about 2, or from about 0.5 to about 1.5 weight percent coating weight.

The printing process can be employed with either or both single component (SCD) and two-component development systems. Toners useful in MICR printing include mono-component and dual-component toners. Toners for MICR include those having a binder and at least one magnetic material. Optionally, the toner may include a surface treatment such as a charge control agent, or flowability improving agents, a release agent such as a wax, colorants and other additives.

Non-MICR Toners

Suitable non-MICR toners for use for printed images on a document that also contains MICR encoding are disclosed in, for example, U.S. Pat. Nos. 6,326,119; 6,365,316; 6,824,942 and 6,850,725, the disclosures thereof are hereby incorporated by reference in their entirety. In embodiments, the non-MICR toner can be black or color, and in embodiments, is color non-MICR xerographic toner.

The non-MICR toner resin can be a partially crosslinked unsaturated resin such as unsaturated polyester prepared by crosslinking a linear unsaturated resin (hereinafter called base resin), such as linear unsaturated polyester resin, in embodiments, with a chemical initiator, in a melt mixing device such as, for example, an extruder at high temperature (e.g., above the melting temperature of the resin, and more specifically, up to about 150° C. above that melting temperature) and under high shear. Also, the toner resin possesses, for example, a weight fraction of the microgel (gel content) in the resin mixture of from about 0.001 to about 50 weight percent, from about 1 to about 20 weight percent, or about 1 to about 10 weight percent, or from about 2 to about 9 weight percent. The linear portion is comprised of base resin, more specifically unsaturated polyester, in the range of from about 50 to about 99.999 percent by weight of the toner resin, or from about 80 to about 98 percent by weight of the toner resin. The linear portion of the resin may comprise low molecular weight reactive base resin that did not crosslink during the crosslinking reaction, more specifically unsaturated polyester resin.

The molecular weight distribution of the resin is thus bimodal having different ranges for the linear and the crosslinked portions of the binder. The number average molecular weight ($M_n$) of the linear portion as measured by gel permeation chromatography (GPC) is from, for example, about 1,000 to about 20,000, or from about 3,000 to about 8,000. The weight average molecular weight ($M_w$) of the linear portion is from, for example, about 2,000 to about 40,000, or from about 5,000 to about 20,000. The weight average molecular weight of the gel portions is greater than 1,000,000. The molecular weight distribution ($M_w/M_n$) of the linear portion is from about 1.5 to about 6, or from about 1.8 to about 4. The onset glass transition temperature (Tg) of the linear portion as measured by differential scanning calorimetry (DSC) is from about 50° C. to about 70° C.

Moreover, the binder resin, especially the crosslinked polyesters, can provide a low melt toner with a minimum fix temperature of from about 100° C. to about 200° C., or from about 100° C. to about 160° C., or from about 110° C. to about 140° C.; provide the low melt toner with a wide fusing latitude to minimize or prevent offset of the toner onto the fuser roll; and maintain high toner pulverization efficiencies. The toner resins and thus toners, show minimized or substantially no vinyl or document offset.

Examples of unsaturated polyester base resins are prepared from diacids and/or anhydrides such as, for example, maleic anhydride, fumaric acid, and the like, and mixtures thereof, and diols such as, for example, propoxylated bisphenol A, propylene glycol, and the like, and mixtures thereof. An example of a suitable polyester is poly(propoxylated bisphenol A fumarate).

In embodiments, the toner binder resin is generated by the melt extrusion of (a) linear propoxylated bisphenol A fumarate resin, and (b) crosslinked by reactive extrusion of the linear resin with the resulting extrudate comprising a resin with an overall gel content of from about 2 to about 9 weight percent. Linear propoxylated bisphenol A fumarate resin is available under the trade name SPAR II™ from Resana S/A Industrias Quimicas, Sao Paulo Brazil, or as NEOXYL P2294 ™ or P2297™ from DSM Polymer, Geleen, The Netherlands, for example. For suitable toner storage and prevention of vinyl and document offset, the polyester resin blend more specifically has a Tg range of from, for example, about 52° C. to about 64° C.

Chemical initiators, such as, for example, organic peroxides or azo-compounds, can be used for the preparation of the crosslinked toner resins.

The low melt toners and toner resins may be prepared by a reactive melt mixing process wherein reactive resins are partially crosslinked. For example, low melt toner resins may be fabricated by a reactive melt mixing process comprising (1) melting reactive base resin, thereby forming a polymer melt, in a melt mixing device; (2) initiating crosslinking of the polymer melt, more specifically with a chemical crosslinking initiator and increased reaction temperature; (3) retaining the polymer melt in the melt mixing device for a sufficient residence time that partial crosslinking of the base resin may be achieved; (4) providing sufficiently high shear during the crosslinking reaction to keep the gel particles formed and broken down during shearing and mixing, and well distributed in the polymer melt; (5) optionally devolatilizing the polymer melt to remove any effluent volatiles; and (6) optionally adding additional linear base resin after the crosslinking in order to achieve the desired level of gel content in the end resin. The high temperature reactive melt mixing process allows for very fast crosslinking which enables the production of substantially only microgel particles, and the high shear of the process prevents undue growth of the microgels and enables the microgel particles to be uniformly distributed in the resin.

A reactive melt mixing process is, for example, a process wherein chemical reactions can be affected on the polymer in the melt phase in a melt-mixing device, such as an extruder. In preparing the toner resins, these reactions are used to modify the chemical structure and the molecular weight, and thus the melt rheology and fusing properties of the polymer. Reactive melt mixing is particularly efficient for highly viscous materials, and is advantageous because it requires no solvents, and thus is easily environmentally controlled. As the amount of crosslinking desired is achieved, the reaction products can be quickly removed from the reaction chamber.

The resin is present in the non-MICR toner in an amount of from about 40 to about 98 percent by weight, or from about 70 to about 98 percent by weight. The resin can be melt blended or mixed with a colorant, charge carrier additives, surfactants, emulsifiers, pigment dispersants, flow additives, embrittling agents, and the like. The resultant product can then be pulverized by known methods, such as milling, to form the desired toner particles.

Waxes with, for example, a low molecular weight $M_w$ of from about 1,000 to about 10,000, such as polyethylene, polypropylene, and paraffin waxes, can be included in, or on the non-MICR toner compositions as, for example, fusing release agents. It is noted that the spray coating would not typically be applied over the non-MICR toners because it is applied to areas of the check that are to contain encoded data.

Various suitable colorants of any color can be present in the non-MICR toners, including suitable colored pigments, dyes, and mixtures thereof including REGAL 330®; (Cabot), Acetylene Black, Lamp Black, Aniline Black; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like; cyan, magenta, yellow, red, green, brown, blue or mixtures thereof, such as specific phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments and dyes that can be selected are cyan, magenta, or yellow pigments or dyes, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Other colorants are magenta colorants of (Pigment Red) PR81:2, CI 45160:3. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Forum Yellow SE/GLN, CI Dispersed Yellow 33 2,5-dimethoxy-4-sulfonanilide phenylazo-4'-chloro-2,5-dimethoxy acetoacetanilides, and Permanent Yellow FGL, PY17, CI 21105, and known suitable dyes, such as red, blue, green, Pigment Blue 15:3 C.I. 74160, Pigment Red 81:3 C.I. 45160:3, and Pigment Yellow 17 C.I. 21105, and the like, reference for example U.S. Pat. No. 5,556,727, the disclosure of which is totally incorporated herein by reference.

The colorant, more specifically black, cyan, magenta and/or yellow colorant, is incorporated in an amount sufficient to impart the desired color to the toner. In general, pigment or dye is selected, for example, in an amount of from about 2 to about 60 percent by weight, or from about 2 to about 9 percent by weight for color toner, and about 3 to about 60 percent by weight for black toner.

The non-MICR toner composition can be prepared by a number of known methods including melt blending the toner resin particles, and pigment particles or colorants, followed by mechanical attrition. Other methods include those well known in the art such as spray drying, melt dispersion, dispersion polymerization, suspension polymerization, extrusion, and emulsion/aggregation processes.

The resulting non-MICR toner particles can then be formulated into a developer composition. The toner particles can be mixed with carrier particles to achieve a two-component developer composition.

Wax Coating

In embodiments, the wax coating is selectively applied to the portion of the document that is to receive secondary MICR encoding. The wax coating is usually applied after the initial printing step (primary MICR and/or non-MICR) and fusing step, but before any secondary MICR encoding has taken place. When the wax is sprayed on the surface of a document prepared by the processes described herein, the magnetic signal strength of the resulting MICR encoded image is comparable to or better than that of a document having no fuser oil thereon.

In embodiments, the coating can be applied at a suitable time before any secondary MICR encoding. The coating can be applied before or in the pre-print production line, at a location at which secondary MICR encoding takes place, and/or at a location intermediate these two locations.

After the wax coating is sprayed, it is dried. Drying can be accomplished by use of ambient air with or without the addition of minimal heat, for example, heating to from about 20 to about 90° C., or from about 25 to about 45° C., or from about 30 to about 38° C.

Suitable wax based coatings comprise aqueous wax emulsions, including but not limited to polyolefins and in particular aqueous polyethylene wax emulsions. In embodiments, the polyethylene wax has a melting point of from about 100 to about 150° C., or from about 125 to about 135° C. In embodiments, the aqueous polyethylene wax emulsion has a viscosity of from about 1 to about 100 centipoise, or from about 5 to about 50 centipoise, or from about 10 to about 20 centipoise. In embodiments, the aqueous polyethylene wax emulsion has a pH of from about 9.0 to about 10.5, or from about 9.2 to about 9.8, or about 9.6. In embodiments, the aqueous polyethylene wax emulsion has a solids content of from about 20 to about 40, or from about 26 to about 34 percent by weight. Particle size of the polyethylene wax may range from 0.05 to 0.1 micron. In certain embodiments, the water content of the aqueous polyethylene emulsion ranges from 55 to 75%. In some cases, an alcohol likely can be used in addition to water or in place of water for the continuous phase of the emulsion.

Non-limiting examples of suitable polyethylene waxes include JONCRYL WAX 26 & JONCRYL WAX 28. JONCRYL WAX 26 is a polyethylene wax from Johnson Polymer/BASF having a melting point of about 130° C., a particle size of from about 50 to about 100 nm, a loading of about 26 percent solids, a density of about 8.2 lbs/gal, a viscosity of about 10 centipoise, and a pH of about 9.8. The wax is a light translucent emulsion in water. JONCRYL WAX 28 is a polyethylene wax from Johnson Polymer/BASF and having a melting point of about 132° C., particle size of from about 80 to about 100 nm, a loading of about 34 percent solids, a density of about 8.3 lbs/gal, a viscosity of about 50 centipoise, and a pH of about 9.2. Other suitable waxes that are commercially available include Baker Petrolite Synthetic Polywax 725 and Baker Petrolite Synthetic Polywax 655.

In some cases, the wax is present in the wet coating in an amount from about 20 to about 60 percent by weight. Suitable surfactants which may be present include Surfynol 504 (from Air Products), which includes a mixture of butanedioic acid, 1,4-bis(2-ethylhexyl) ester, sodium salt; NOVEC FC4432 (from 3M), which includes perfluorobutane sulfonates; and the like surfactants, and mixtures thereof. The surfactant may be present in the wax coating in an amount of from about 0.1 to about 5 percent, or from about 0.5 to about 1 percent by weight. A surfactant is a surface-active agent that accumulates at the interface between 2 liquids and modifies their surface properties. Additives such as a UV fluorescing tag also can be included.

Viscosity modifiers may also be present and include those which are alkali swellable, such as Acrysol ASE-60 (from Rohm & Haas), and associative thickeners such as Rheolate 255 (available from Elementis), and mixtures thereof. Humectants including but not limited to diethylene glycol can be added to the formulation to prevent spray nozzle clogging. Further details of suitable wax coatings are provide in commonly assigned U.S. patent application Ser. No. 11/523,283 filed Sep. 18, 2006, the contents of which are incorporated herein by reference in their entirety.

The wax coating typically has a surface tension of from about 10 to about 50, or from about 22 to about 34 mN/m. This surface tension may be adjusted to closely match that of the fuser oil (often about 22 mN/m) to ensure complete wetting of the document.

The coating can be applied to selected portions of the document by any suitable spray coating method. In some cases, the coating is applied to a thickness of from about 1 to about 10, or from about 1 to about 5 microns wet. In some cases, the dried coating has a thickness of about 0.5 microns to about 5 microns after drying. The document can be dried using known methods including air drying, infrared drying, and the like. The coating provides sufficient wetting to allow for a uniform coating over oil covered, fused toner documents.

Non-limiting examples of suitable spray techniques include an air propelled brush, an air atomized spray device, a hydraulic spray device, or an ultrasonic spray device. Material could also be applied via piezo ink-jet or similar technology. In embodiments, the air brush dispenses a wet mass per area of about 0.1 to about 10 mg/cm2 of emulsion, or about 0.1 to about 5 mg/cm2, or about 2.0 to about 4.5 mg/cm2. The applicator is activated as the document passes under the nozzle (a fixed distance) at the process speed of the printing line to which the spray step is added. If the region to be sprayed is narrow, the spray nozzle can be turned at an angle or a mask can be used to cover portions of the document that do not need to be coated.

After the coating is placed on the document and dried, secondary MICR imprinting may take place. Any suitable encoder can be used to supply the MICR encoding. As a non-limiting example, an NCR 7766-100 encoder, available from NCR Corporation, can be used. This device employs a magnetic thermal transfer ribbon, which places the ink from the ribbon onto the dried coating. An encoder using an impact transfer ribbon also can be used.

MICR Ink Compositions for Transfer Ribbon Printing

The MICR ink compositions selected herein for use in secondary MICR encoding using a transfer ribbon process typically comprise a dried film supported on a ribbon. The film includes magnetic material, which usually is a particulate material, a binder, a colorant (if needed in additional to the magnetic material), and other optional additives, including a release agent, such as an oil or wax component. Non-limiting examples of waxes include carnauba wax and low molecular weight polyethylene. The magnetic material can be an organic molecule-based magnetite and/or an inorganic magnetite. The binder is usually one or more thermoplastic resins used in coating formulations. Multiple resins can be combined to provide the desired property profiles. The colorant typically is pigments, dyes and/or carbon black. The ribbon typically has a thickness of about 5 microns, the binder layer has a thickness of about 25 microns and the ink/wax layer has a thickness of about 5 microns. Solvents are often used in preparing the ink-containing ribbon. Additional description of certain MICR inks that can be applied using a thermal transfer ribbon can be found in U.S. Pat. No. 5,866,637 assigned to NCR Corp., the contents of which are incorporated by reference herein in their entirety.

As indicated above, the coating layer creates a film which enables adhesion of the magnetic ink from the magnetic thermal transfer ribbon, overcoming forces caused by the surface amino oil and/or covering up the oil, and therefore leaves a surface on which further MICR encoding can be carried out with a rejection rate which is greatly improved over oil-coated prints that do not include the wax coating. Typically, when the document is a check, a narrow area of the check is sprayed, e.g. a 0.5-5 cm wide portion across the long edge of the check (the MICR encoding line). In embodiments, the system can be incorporated in-line with a non-MICR printer, usually after the fusing step. This technique facilitates the mitigation of oil which contaminates the surface of the substrate after the fusing step.

Paper cockle is a condition in which bumps or ridges are formed on a printed sheet of paper, resulting in a wavy appearance. Spraying only a small area along the document MICR line minimizes paper cockle as compared to covering the entire document surface. With curl, the edges of the paper move towards the center of the paper, sometimes forming a curled tube. To measure curl, one measures the height of each corner of a sheet of paper that is lying on a flat surface. The presence of cockle often reduces the degree of curl. The disclosed embodiments enable coatings to be applied to portions of documents such that the resulting document exhibits cockle of no more than 5 mm.

Referring now to FIG. 1, a system and corresponding method for encoding data on pre-printed forms is designated as 100. A pre-printed document moves as shown by the document flow arrow of FIG. 1. A printer 120 pre-prints a document in a process that employs fuser oil, and a spray coater 122 applies a wax coating to at least the area of the document to be subsequently encoded. In many cases, the spray coater 122 is activated as the document passes under the nozzle of the spray coater at the process speed of the system. Then, a MICR encoder 124, at a different location than the spray coater, adds the secondary MICR encoded data to the document. It is noted that in certain circumstances the spray coater 122 can be positioned upstream from the printer 120. In this alternative embodiment, the spray coater applies a coating layer to the document that subsequently is contacted with fuser oil during the pre-printing process. In some cases, the document is subjected to a finishing process, such as lamination or binding, after spray coating and before MICR encoding.

Figure 2:
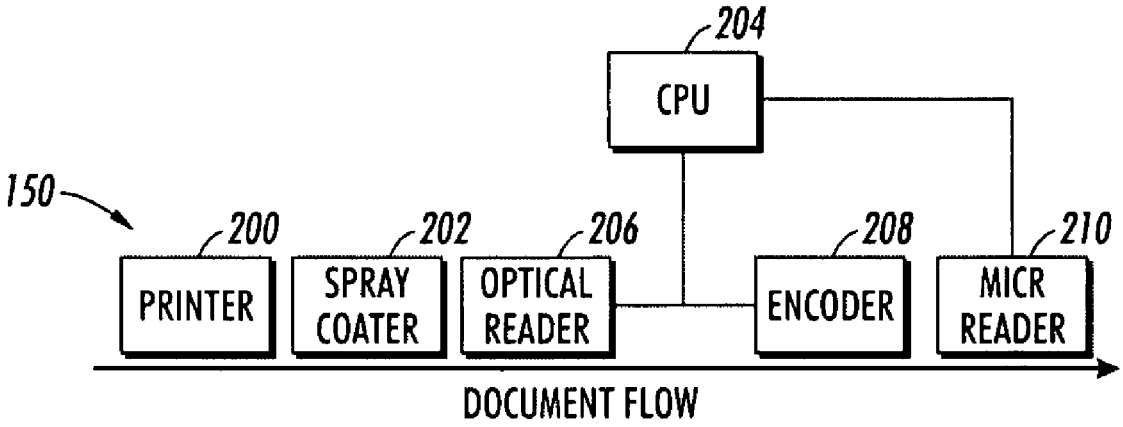
FIG. 2 is a schematic drawing of another system and method described herein.
Figure 3:
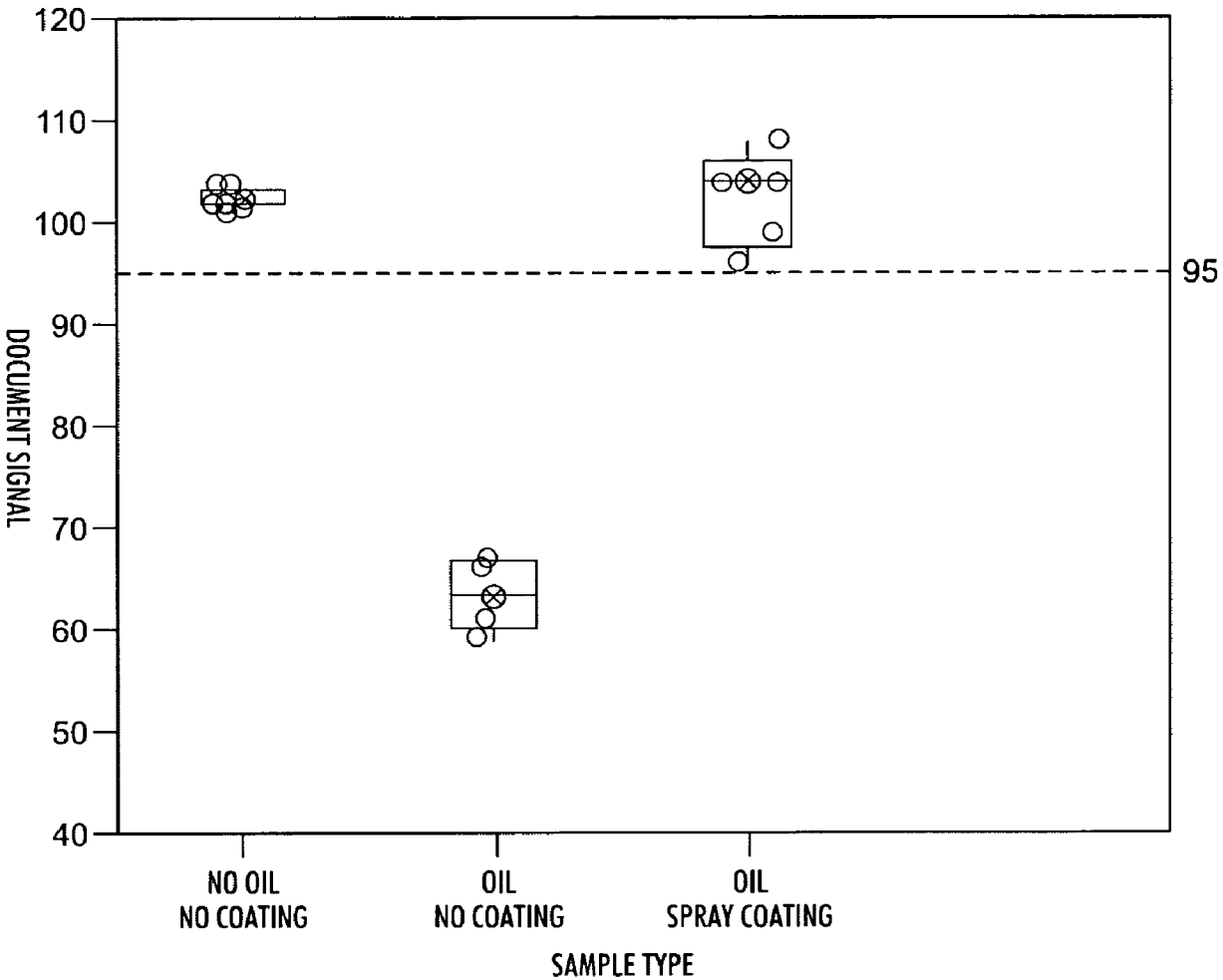
FIG. 3 is a box plot of magnetic signal strength, showing the relative magnetic signal strengths of printed MICR encoded documents that have no fuser oil present as compared to documents that have fuser oil, some of which are spray coated prior to MICR encoding.

Another system and corresponding method for printing, coating, scanning, and encoding is shown in FIG. 2 and is designated as 150. More specifically, FIG. 2 illustrates a printer 200, a spray coater 202, an optical reader 206, a central processing unit (CPU) 204, an encoder 208, and an optional second (MICR) reader 210. The readers 206, 210, CPU 204, and encoder 208 are standard commercially available items and are well-known to those ordinarily skilled in the art. Therefore, a detailed discussion of the same is omitted herefrom.

A pre-printed document moves as shown by the document flow arrow of FIG. 2, and after pre-printing by the printer 200 the portion of the document to be encoded is coated using the spray coater 202. In many cases, the spray coater 202 is activated as the document passes under the nozzle of the spray coater at the process speed of the system. After application, the coating is dried and cured. The data to be read and subsequently encoded is added to the document at any time during or after it is pre-printed, but before it is encoded by the encoder 208. Data to be encoded is then read by the optical reader 206. In the optical reader 206, a device reads (e.g., scans) data that was previously recorded in the preprinted document and processes the scanned data in, for example, an optical character recognition (OCR) process (see U.S. Pat. No. 6,782,144, the complete disclosure of which is incorporated herein by reference, for a description of OCR and scanning systems). The read data is encoded at 208. The optional second reader 210 can be used to verify the encoding process.

The spray coating process can occur at any point prior to the MICR encoding, including before or after the document is pre-printed at 200 and before or after the document is read in item 206. Thus, the spray coater 202 can be positioned before the printer or after the reader 206, and can be completely separate from the printer 200 and/or the reader 206. Usually, however, the spray coater 202 is positioned after the printer 200 and before the reader 206 because post-encoding typically is done by a financial institution.

The central processing unit 204 performs the necessary processing, such as optical character recognition (OCR), and instructs the encoder 208 to encode the MICR data on the document as the document passes by the encoder 208. For example, the method can read data that was hand written or machine printed by the user in a blank preprinted form. For example, the method can read monetary amounts hand written or printed in blanks of pre-printed documents.

In the systems and methods shown in FIGS. 1 and 2, the spray coating provides the subsequently MICR encoded image with sufficient adhesion and magnetic signal strength that the MICR image can be accurately read electronically. Thus, the disclosed method can record the processed data on the coated portion of the document using a MICR encoder in item 208 without encountering problems with fuser oils such that those containing amino-functional group release agents.

The following Examples are intended to illustrate and not limit the scope herein.

EXAMPLE 1

Xerox check stock 4024 DP, 24# (green perforated letter check) was run through an iGen3 (Xerox Corp.) fusing subsystem to coat the paper stock with a representative amount of oil, ~8 microliters of oil per copy. A portion of the check stock having a length of about 22 cm and a width of about 0.5 cm was then subjected to an air-brush spray of an aqueous wax emulsion having Formulation 1 shown below using a Paasche VL-SET airbrush. This portion extended horizontally from the left side of the check and was about 0.25 cm from the bottom of the check.

Formulation 1:

- 2.49 wt % Acrysol ASE-60 (Rohm & Haas), a proprietary alkali swellable, crosslinked, acrylic thickener;
- 97.51 wt % Jonwax 26 (BASF/Johnson Polymer), a proprietary polyethylene wax emulsion having about 20-30% solids in water The spray was directed vertically downward. About 2.5-4.5 mg/cm2 of the coating was applied on a wet basis.

After coating and drying, the secondary encoding took place. This was done using a NCR 7766-100 encoder (NCR Corp.) with a magnetic thermal transfer ribbon (MTTR) which placed the ink (secondary encoding) on the dried wax emulsion. After secondary encoding, testing of the completely finished check was conducted by measuring the magnetic signal strength of the secondary encoding. This was done by running the check through a MICR Qualifier GTX (RDM Corp.).

Generally speaking, a check which does not contain any oil (mercapto or otherwise) will produce a magnetic signal strength of approximately 98%±2%. However, when covered with 0.09% amino functionalized fuser oil such as an iGen3 fuser oil, the magnetic signal strength decreases to approximately 50-70%. In the coated examples, the magnetic signal strength in several instances was measured to be approximately ~100% of the standard MICR waveform (i.e. equal to or better than a blank check with no fuser oil). This high magnetic signal strength of greater than or equal to 80% or more would lead to a reader reject rate for the document of no more than about 0.5%.

Cockle was measured for spray treated samples and was found to be between 0.5 mm and 1.5 mm.

The procedure described above was repeated using various formulations of wax emulsions. The thickener content ranged from about 1.2 to about 2.8 wt %, with the remainder being the wax components. Acceptable levels of magnetic signal strength (greater than 80%) were obtained for each formulation.

EXAMPLE 2

Figure 4:
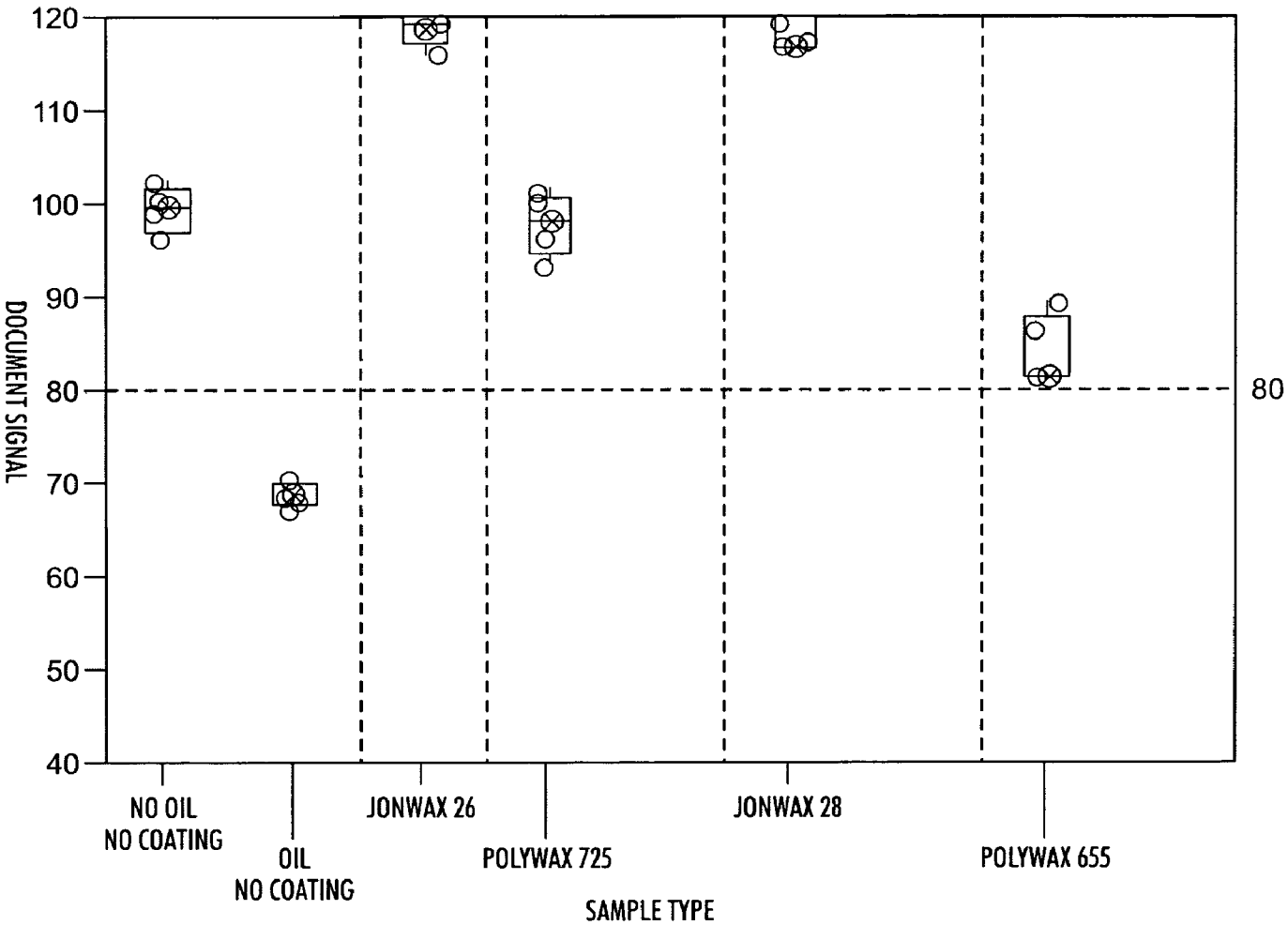
FIG. 4 is a box plot of magnetic signal strength when portions of MICR encoded documents are spray coated with various wax compounds prior to encoding.

Other polyethylene wax emulsions (without thickener) were wiped across the MICR line using a saturated cloth. As is shown in FIG. 4, these other wax emulsions also had the ability to mitigate the effect of surface oil. Those that were tried include BASF/Johnson Polymer Jonwax 26 and 28, Baker Petrolite Synthetic Polywax 655 and Baker Petrolite Synthetic Polywax 725. All of these materials resulted in MICR encoded images having a magnetic signal strength of at least 80%. The values for Jonwax 26 and 28 were over 110%.

EXAMPLE 3

Xerox check stock 4024 DP, 24# (green perforated letter check) was run through an iGen3 fusing subsystem or a Xerox DocuTech 128/155/180 machine to coat the paper stock with a representative amount of amino fuser oil, about 8-14 mg/copy for iGen3 and about 6-9 mg/copy for DocuTech. Next, the check stock was subjected to an air-brush spray of an aqueous wax emulsion having Formulation 2, shown below, which was sprayed onto a portion of the check surface at a process speed of 28.1 m/min.

Formulation 2:

95.5 wt % Jonwax 26 (BASF/Johnson Polymer)

2.5 wt % Acrysol ASE-60 (Rohm & Haas) and 2 wt % IFWB-C2, a fluorescent tag dye (Risk Reactor, Huntington Beach, Calif.)

After the coating was dried under ambient conditions, the secondary encoding took place. This was done using a NCR 7766-100 encoder (NCR Corp.) using a magnetic thermal transfer ribbon (MTTR) which places the ink (secondary encoding) on the dried wax emulsion. After this, the finished document was tested by measuring the magnetic signal strength of the encoding by running the check through a MICR Qualifier GTX (RDM Corp.).

Figure 5:
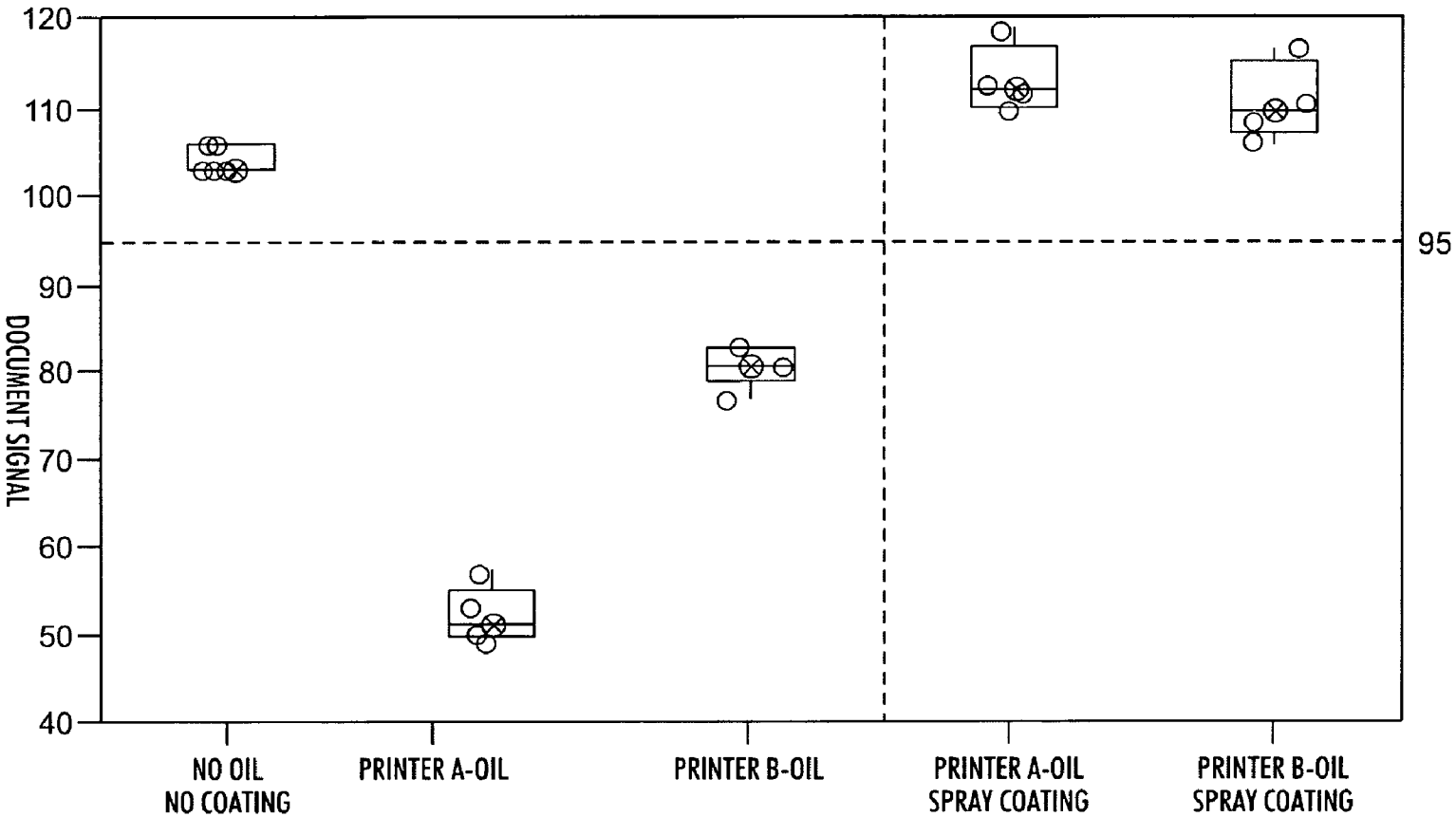
FIG. 5 is a box plot of magnetic signal strength when portions of MICR encoded documents printed on two different printers are spray coated with a wax compound.
Figure 6:
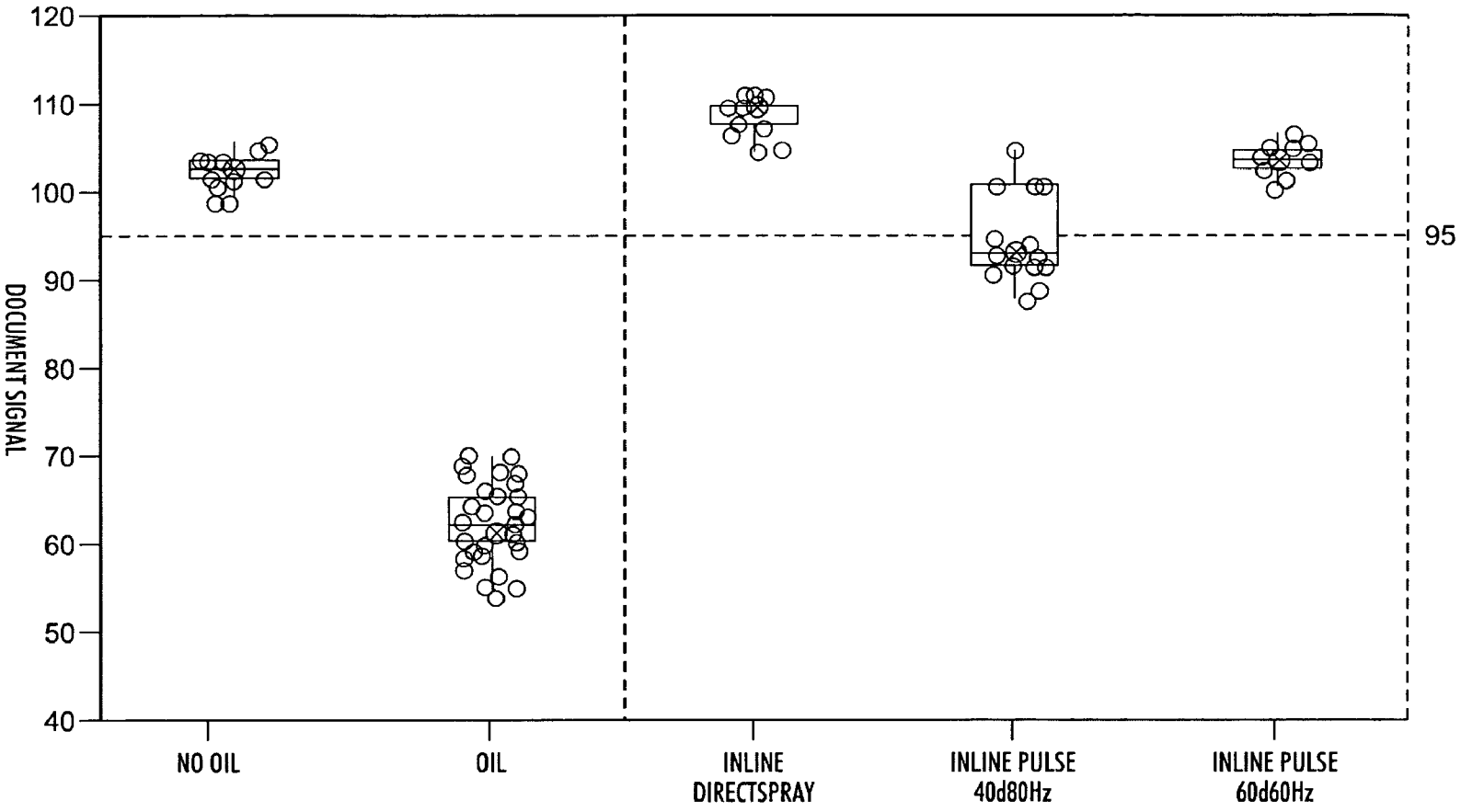
FIG. 6 is a box plot of magnetic signal strength when the wax coating is applied with air atomized spray equipment.

As is shown on FIG. 5, when treated with the Jonwax 26 aqueous polyethylene wax Formulation 2 applied via Paasche Airbrush (pointed vertically downward), oiled and treated DocuTech prints (Printer B on FIG. 5) exhibited encoded magnetic signal strengths of 111% ANSI standard signal. This magnetic signal strength is greater than the un-oiled, untreated (as-is) check-stock which had a post encoded magnetic signal strength 104%. The iGen3 samples (Printer A on FIG. 5) were compared with the DocuTech samples. The oiled and treated iGen3 samples had average post-encoded magnetic signal strength of 114% of the ANSI standard signal, which is similar to previous results gathered during testing.

Oil contamination in Example 3 was not as severe as that of Example 1, and this was reflected in MTTR encoded magnetic signal strengths of oiled but uncoated DocuTech 128/155/180 prints which averaged 81% of ANSI standard signal, compared to iGen3 prints which averaged 52%. This is consistent with DocuTech 128/155/180 putting less oil on each document (6-12 mg/copy, 0.06 mol % amino) and with less mol % amino in the oil than in iGen3 fuser oil (8-14 mg/copy, 0.09% mol % amino).

EXAMPLE 4

Xerox check stock 4024 DP, 24# (green perforated letter check) was run through an iGen3 (Xerox Corp.) fusing subsystem to coat the paper stock with a representative amount of oil, about 8+/−3 microliters of oil per copy. The MICR line of the check stock, having a length of about 21 cm and a width of about 2 cm, was then subjected to an air-brush spray of an aqueous wax emulsion having Formulation 3 (shown below) using an air atomized spray device from Spray Co.

Formulation 3:

31.9 wt % diethylene glycol (Sigma-Aldrich)

67.6 wt % polyethylene wax (Joncryl Wax 26)

0.5 wt % fluorescent tag dye (IFWB-14, Risk Reactor, Huntington Beach, Calif.)

The diethylene glycol was a humectant added to prevent clogging of the spray device. The coating formulation was aqueous based and had 17.6 wt % solids. The fluid pressure of application was 35 kPa and the air pressure was 103 kPa. The speed through the spray device was 28.1 m/min. A first set of documents was sprayed with a direct (unpulsed) spray, a second set was sprayed at a pulsed 40 duty cycle, and a third set was sprayed at a pulsed 60 duty cycle.

After coating and drying, the secondary encoding took place. This was done using an NCR 7766-100 encoder (NCR Corp.) with a magnetic thermal transfer ribbon (MTTR) which placed the ink (secondary encoding) on the dried wax emulsion. After secondary encoding, testing of the completely finished check was conducted by measuring the magnetic signal strength of the secondary encoding. This was done by running the check through a MICR Qualifier GTX (RDM Corp.). Magnetic signal strength results are shown below on Table 1 and cockle/curl data is shown on Table 2.

TABLE 1

Magnetic signal strength Measurements of Inline Runs

| Sample ID | Average Magnetic signal strength | | | | # of Characters (out of 34 total) with low signal (GTX) | # of unrecognized Characters (out of 34 total) (GTX) |
|---|---|---|---|---|---|---|
| | Document | Amount Field | ON-US Field | Transit Field | | |
| No Oil, No Treatment | 101.6 | 99.4 | 101 | 104.8 | 0 | 0 |
| Nominal oil, No treatment | 64.6 | 61.7 | 68.4 | 63.7 | 4.1 | 1.3 |
| #1—Direct Spray, 100 duty cycle, 3.0 cm | 108.9 | 108.1 | 109.7 | 109.3 | 0.0 | 0.0 |
| #2—Pulsed Spray at 40 duty cycle, 80 Hz, 6.0 cm | 94.6 | 93.9 | 95.9 | 93.6 | 0.0 | 0.5 |
| #3—Pulsed Spray at 60 duty cycle, 60 Hz, 4.5 cm | 104.1 | 104.3 | 105.1 | 103.2 | 0.0 | 0.0 |

TABLE 2

Page Cockle/Curl of Inline Treated Air Atomized Spray Runs

| | No Oil, No Treatment | Nominal oil, No treatment | #1—Direct Spray, 3 cm | #2—Pulsed Spray at 40 duty cycle, 80 Hz, 6 cm | #3—Pulsed Spray at 60 duty cycle, 60 Hz, 4.5 cm |
|---|---|---|---|---|---|
| Cockle/Curl (mm) | 0 | 0.5 ± 0.5 | 8.9 ± 2.9 | 4.0 ± 1.5 | 8.6 ± 2.7 |

An un-oiled check had MICR magnetic signal strength of 102%. The encoded magnetic signal strength of the iGen3 oiled check dropped to 65%, with some instances of low magnetic signal strength and unrecognized characters. It is noted that while low signal and unrecognized characters read on the GTX MICR Qualifier, they do not correlate directly to reject rate, but rather they are an indicator. Direct Spray (#1) conditions improved document magnetic signal strength to 109%, however this technique introduced a fair amount of cockle, averaging 8.9 (due primarily to page curl) which was less observable in the stack of 600 sheets, but on individually measured sheets, was quite prominent. In all the measured cases, the deformation of the sheet looked more like page curl rather than cockle. Pulsed spray at 40 duty cycle (#2) showed lower magnetic signal strength than expected, 95%, but it is consistent with less mass being applied to the sheet. Cockle/curl was reduced compared to direct spray. Pulsed spray at 60 duty cycle (#3) showed good magnetic signal strength, 104%, but the page cockle/curl was closer to the Direct Spray level (8 mm). There is no identified specification for page curl or cockle but it becomes noticeable when it is >3 mm, as is the case for all three runs, the results of which are shown above on Table 2.

PROPHETIC EXAMPLE 5

The procedure of Example 4 is repeated with the exception that the portion of check stock that is sprayed with an air atomized spray device has a length of about 5 cm and a width of about 1 cm. Cockle measurements of less than 5 mm are expected for all samples, whether sprayed using pulsed or unpulsed spray conditions. A cockle measurement of 5 mm is commercially acceptable. The magnetic signal strength levels obtained in Example 4 are expected.

The printing systems and methods described herein can be used for coating checks and other individually identifiable documents to be used in many applications including electrophotographic, ionographic or magnetographic printing, especially MICR and related processes, including digital systems. The details of printers, printing engines, etc. are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims. Unless specifically defined in a specific claim itself, steps or components of the invention should not be implied or imported from any above example as limitations to any particular order, number, position, size, shape, angle, color, or material.

What is claimed is:

1. A printing system comprising:

a first printer configured to print a first set of data on a document, the first printer including a fuser employing fuser oil, the fuser depositing residual fuser oil on the document, and an in-line spray coater disposed downstream from the fuser and configured to deposit a wax coating over the residual fuser oil on a portion of the document.

2. The printing system of claim 1, wherein the fuser oil contains an amino-functional group release agent.

3. The printing system of claim 1, further comprising a second printer positioned downstream from the spray coater configured to print magnetic ink character recognition data over the coated portion of the document.

4. The printing system of claim 3, wherein the second printer is a magnetic thermal transfer ribbon printer.

5. The printing system of claim 1, wherein the spray coater is an air propelled brush.

6. A printing system, comprising:

a spray coater configured to deposit a wax coating on a portion of a pre-printed document to mitigate fuser oil on the document, an electronic reader configured to read an amount on the pre-printed document, a data processor configured to process the electronically read amount, and a magnetic ink character recognition encoder configured to encode the read amount on the coated portion of the pre-printed document.

7. The printing system of claim 6, wherein the magnetic ink character recognition encoder is a magnetic thermal transfer ribbon printer.

8. A method comprising:

performing a printing process to produce a pre-printed document, the printing process resulting in a residual coating of fuser oil on the surface of the pre-printed document, and spraying a portion of the pre-printed document with a wax emulsion to form a coated portion configured to mitigate fuser oil and subsequently receive and retain a magnetic image.

9. The method of claim 8, wherein the fuser oil comprises an amino-functional group release agent.

10. The method of claim 8, wherein spraying takes place after the printing of the pre-printed document.

11. The method of claim 8, wherein the document exhibits cockle of no more than 5 mm.

12. The method of claim 8, wherein the coating is sprayed with an air propelled brush.

13. The method of claim 8, wherein the printing process and the spraying process take place within the same production line.

14. The method of claim 8, wherein the coated portion is configured to subsequently receive and retain a magnetic image having a magnetic signal strength of at least 80%.

15. The method of claim 8, wherein the coated portion is configured to subsequently receive and retain a magnetic image having a magnetic signal strength of at least 95%.

16. The method of claim 8, further comprising applying a magnetic image to the coated portion using a magnetic ink character encoding process.

17. The method of claim 16, wherein the magnetic ink character encoding process employs a transfer ribbon printer.

18. The method in claim 16, wherein the magnetic ink character encoding process is a thermal transfer ribbon process.

19. A method comprising:

performing a printing process to produce a pre-printed document, the printing process resulting in a residual coating of fuser oil on the surface of the pre-printed document, spraying a portion of the pre-printed document with a wax emulsion to form a coated portion configured for future application of a magnetic image, and processing the pre-printed document in at least one of a binding and a lamination process.

20. The method of claim 19, wherein the coated portion is configured to subsequently receive and retain a magnetic image having a magnetic signal strength of at least 80%.

21. A method comprising:

spray coating with a wax emulsion a portion of a pre-printed document having fuser oil thereon, reading an amount that was previously printed on the pre-printed document, processing the amount into processed data, and recording the processed data on the spray coated portion using a magnetic ink character recognition encoder having a thermal transfer ribbon.

22. The method of claim 21, wherein the fuser oil contains an amino-functional group release agent.

* * * * *